US005967360A

United States Patent [19]

Cheng-Tien

[11] Patent Number: 5,967,360

[45] Date of Patent: Oct. 19, 1999

[54] FRICTIONALLY ENGAGED ADJUSTABLE WIRE BASKET

[75] Inventor: Liu Cheng-Tien, Taipei, Taiwan

[73] Assignee: John Gusdorf and Associates, Ltd., St. Louis, Mo.

[21] Appl. No.: 09/133,099

[22] Filed: Aug. 12, 1998

[51] Int. Cl.[6] ..... B65D 6/08

[52] U.S. Cl. ..... 220/489

[58] Field of Search ..... 220/489, 485

[56] References Cited

U.S. PATENT DOCUMENTS

| | | | |
|---|---|---|---|
| 858,543 | 7/1907 | Sickmiller | 220/489 |
| 2,121,403 | 6/1938 | Lapinskas | 220/489 |
| 2,573,770 | 11/1951 | Meadow | 220/489 |
| 2,812,098 | 11/1957 | Escaut | 220/489 |

*Primary Examiner*—Joseph M. Moy
*Attorney, Agent, or Firm*—Paul M. Denk

[57] ABSTRACT

A frictionally adjustable wire basket having a bottom or base section and a continuous, circumferential wall section connected thereto. The wall section is comprised of a plurality of intertwined, frictionally engaged resilient wire loops. Each of the wire loops also is connected to the base section in a hinged yet frictionally biased engagement. The basket wall can be moved in various configurations relative to the base section and secured in the desired configuration by the combination of the frictionally engaged intertwined wall loops and the frictionally engaged hinge connection. The wall is capable of movement about the hinged connection from a nearly vertical relationship to the base section to a flat arrangement for packing and shipping. The base section and the wall loops can be constructed from any appropriate resilient material such as wire.

7 Claims, 3 Drawing Sheets

FRICTIONALLY ENGAGED ADJUSTABLE WIRE BASKET

RELATED APPLICATIONS

None

BACKGROUND OF THE INVENTION

This invention relates generally to containers and, more specifically to a frictionally engaged, adjustable wire basket.

Baskets or similar containers are known to the art. Generally, such baskets are formed or woven from a natural fibrous material type material such as straw, palm fronds or other related materials. Baskets formed from non-fibrous material, such as metal wire also are known. Generally these types of baskets or formed from interwoven wire. The wire can be bare, can be painted or even coated with a polymer material such as plastic or vinyl.

The foregoing prior art baskets have a multitude of uses. The baskets can be used for any conceivable type of storage or transport. Among their many uses, baskets traditionally are used to hold fruit, flowers, potted plants or the like. The baskets also can be suspended by appropriate connectors so as to create a hanging basket for decorative or functional purposes.

Prior art baskets have one notable drawback. Whether formed from natural fibrous material or formed from wire, the baskets are woven or made in one size and one configuration. That is, once the basket is woven, the size does not vary, except slightly in the case of natural fibers that may dry and shrink. Moreover, the configuration of the basket cannot be changed. Thus, the prior art baskets have limited versatility. For example, it is common to place a potted plant inside a basket for decorative or aesthetic reasons. The plain clay or plastic pot, which contains the potting soil and the plant root, can thereby be hidden from view. The configuration and volume of the basket will limit the size or configuration of the pot it can hold. If the use wants to house different sized pots in a basket, the user obviously must have different sized baskets.

Further, with conventional baskets, the number that can be packaged and shipped is limited. The most convenient way to package and ship conventional baskets is to arrange them in a nesting relationship and pack them in a box. However, this arrangement still limits the number of baskets that can be conveniently and economical shipped.

It would be advantageous, therefore, to have a decorative basket that can assume different configurations so as to accommodate variably configured contents. Moreover, it would be convenient to have such a basket wherein one of the variable configurations is flat so that a plurality of the baskets can be conveniently stacked for economical storage and transport.

OBJECTS OF THE INVENTION

It is among the several objects of the present invention to provide a frictional engaged adjustable basket that can be arranged in a plurality of configurations.

It is another object of the present invention to provide such a basket that has members in a frictionally engaged arrangement so as to maintain the basket in desired configurations.

Another object of the invention to provide such a basket wherein at least one of the configurations is flat for convenient storage and shipping.

Another object of the invention is to provide such a basket that can be used in a variety of environments including resting on a surface or suspended in a hanging arrangement.

Another object of the invention is to provide such a basket that is constructed from a durable, long lasting, aesthetically pleasing material.

Yet another object of the invention is to provide such a basket that is simple and economical to construct, easy to use and well suited for its intended purposes.

In accordance with the invention, generally stated, a frinctionally adjustable wire basket is provided having a bottom or base section and a continuous, circumferential wall section connected thereto. The wall section is comprised of a plurality of intertwined, frictionally engaged wire loops. Each of the wire loops also is connected to the base section in a hinged yet friction engagement. The combination of the frictionally engaged intertwined wall loops and the frictionally engaged hinge connection allows the wall to be moved in various configurations relative to the base section and secured in the desired configuration by the frictional engagements. The wall can be moved about the hinged connection from a nearly vertical relationship to the base section wherein the basket is disposed to hold a desired contents, all the way to a flat arrangement for packing and shipping. The base section and the wall loops can be constructed from any appropriate material such as wire. The wire can be painted or coated with an appropriate covering to preserve the wire and to enhance appearance. Further, the basket can be constructed from a polymer, such as high impact plastic or nylon or other appropriate non-metallic material without departing from the scope of the invention.

BRIEF DESCRIPTION OF THE DRAWINGS

Corresponding reference numerals indicate corresponding structure throughout the description of the preferred embodiment.

DESCRIPTION OF THE PREFERRED EMBODIMENT

Figure 1:
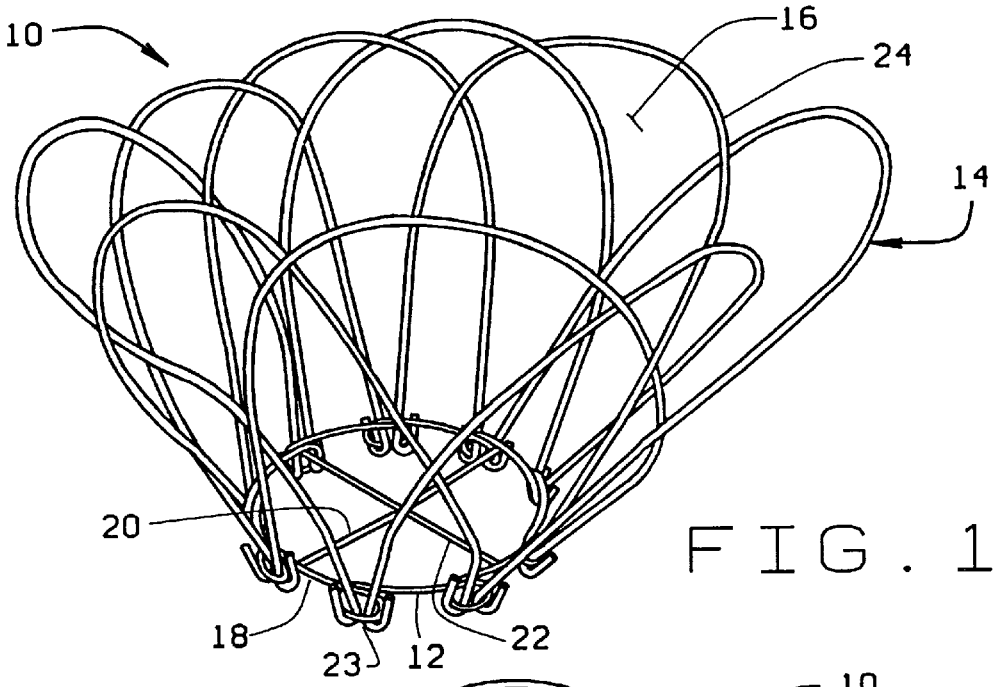
FIG. 1 is a perspective view of one embodiment of the frictionally engaged adjustable basket of the present invention, the basket wall being in an upright relationship to the base.
Figure 3:
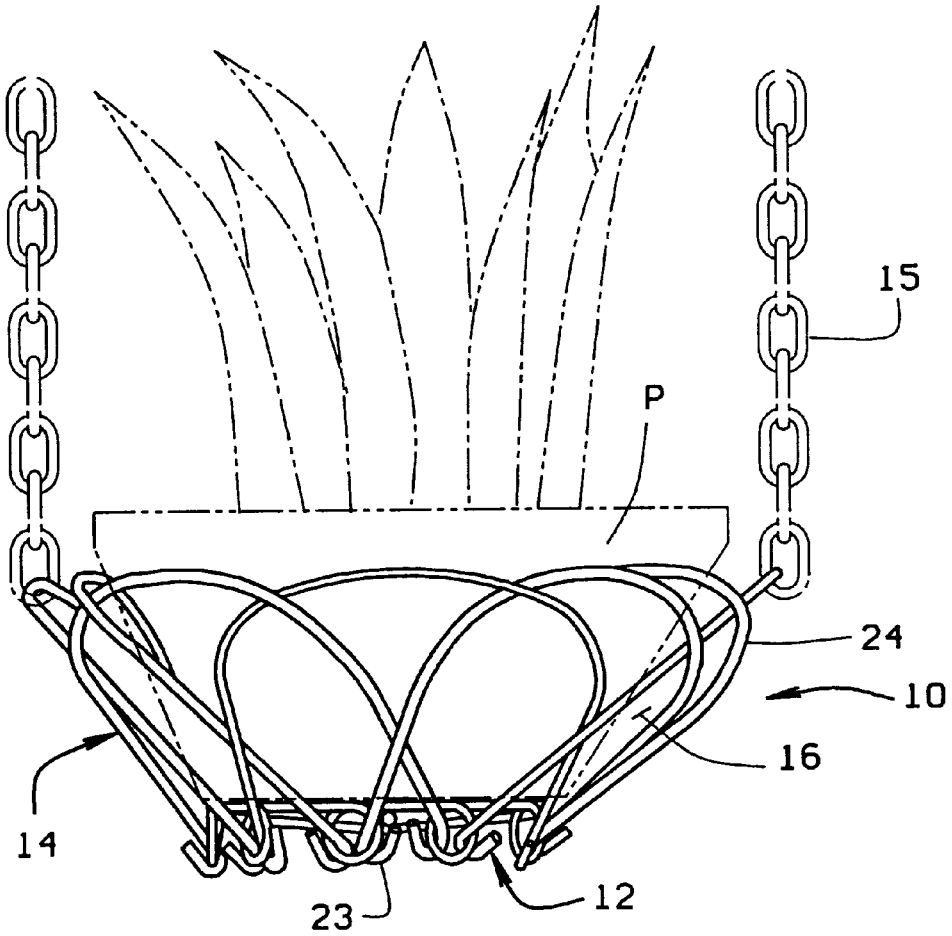
FIG. 3 is a side elevation of another embodiment of the present invention employing hanging chains, having a potted plant shown in phantom therein to illustrate environment.
Figure 4:
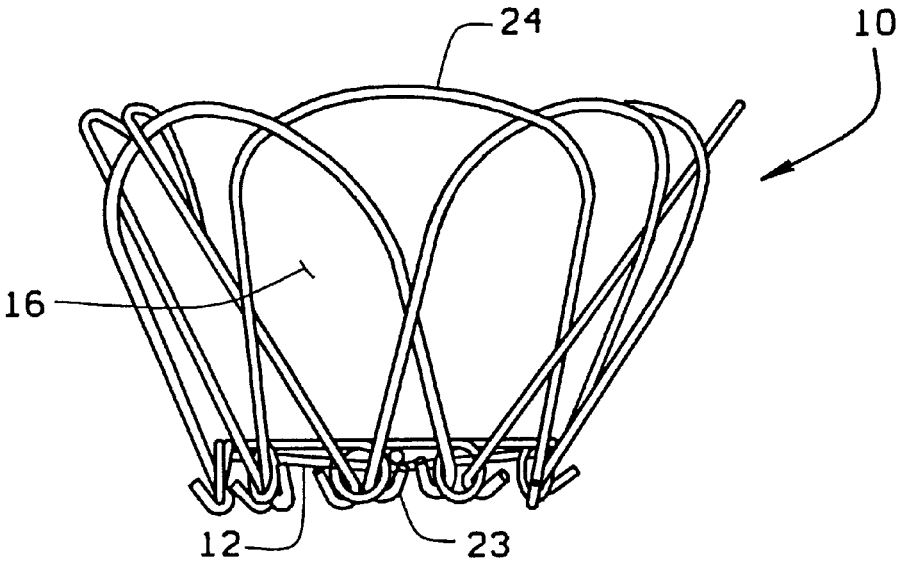
FIG. 4 is a side elevation of the first embodiment of the frictionally engaged basket of the present invention, the basket wall being in an upright relationship to the base.

The frictionally engaged adjustable basket made in accordance with the principles of the present invention will now be described in detail. The frictionally engaged adjustable basket is indicated generally in the drawings by reference numeral 10. Basket 10 is comprised of a base section 12 and an adjustable basket wall 14. It will be appreciated that base section 12 and basket wall 14 cooperate to form a basket for containing various contents in an internal volume 16 defined by the base section and the basket wall. The basket 10 can be configured to set on a surface, as shown in FIGS. 1 and 4 or can include hanging elements, such as decorative chains 15, shown in FIG. 3. The individual features and elements of the base section and the basket wall, as well as the structural and functional relationship of the base section and basket wall, will now be described in greater detail.

Figure 2:
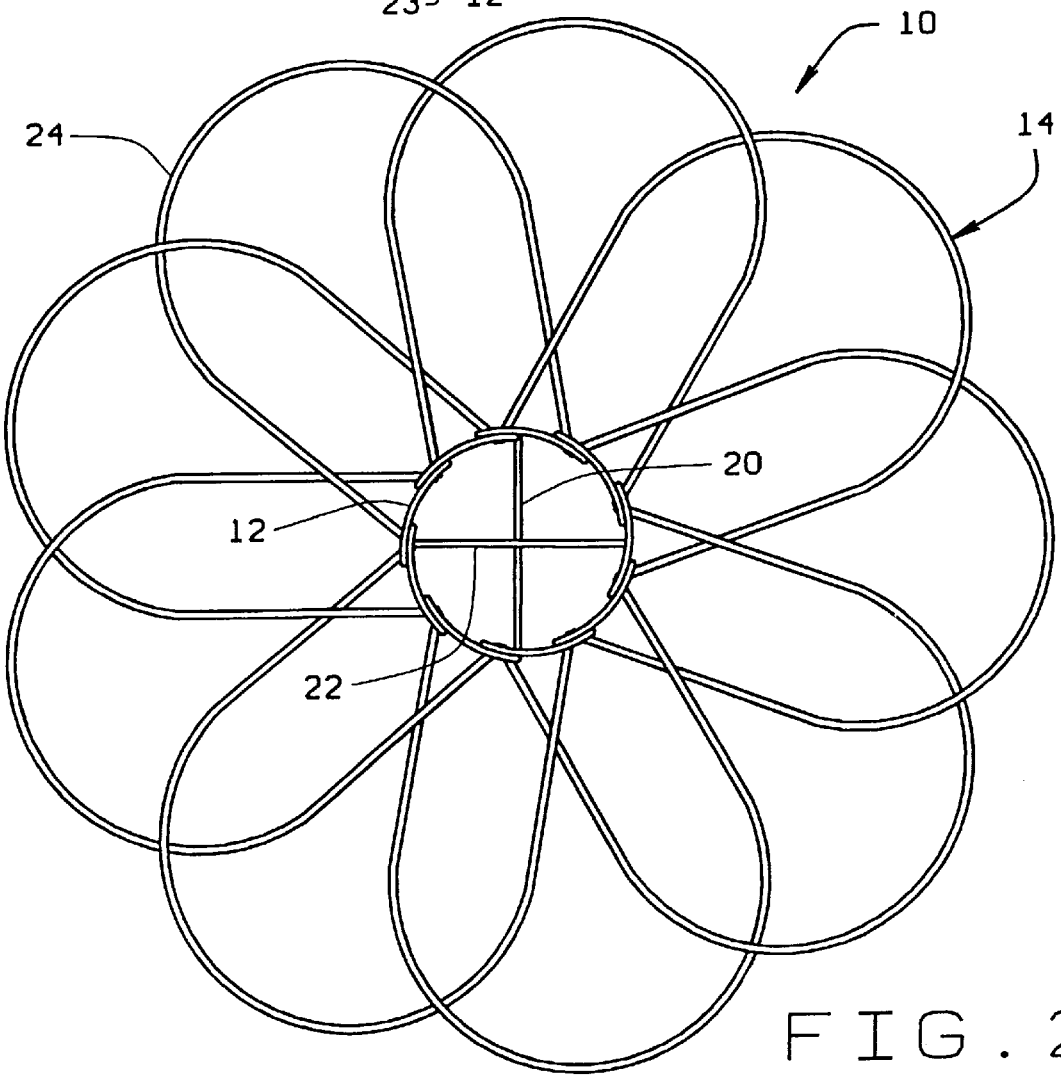
FIG. 2 is a top plan of the basket of FIG. 1 with the basket wall and base in a flat relationship.
Figure 6:
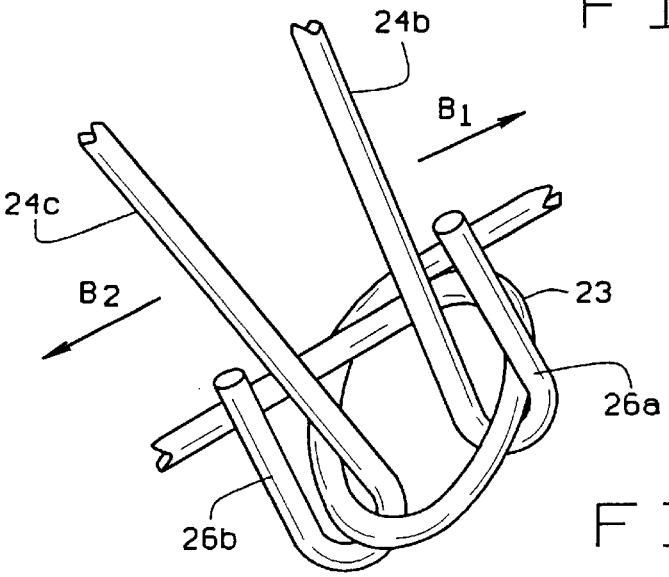
FIG. 6 is an enlarged section of the frictionally engaged hinge between a wall loop section and the base section.

Base section 12 is shown in greater detail in FIGS. 1 and 2. Base section 12, in the illustrated embodiment, includes a circular frame member 18. Further, the based includes first and second cross members 20 and 22 which divide circular frame 18 into four equal quadrants. It will be appreciated that cross members 20 and 22 serve both to add strength and rigidity to the base section and to provide support or resting surface for the contents of the basket while in use. It also will be appreciated that addition cross members may be used or that cross members may be added in various arrangement without departing from the scope of the invention. For example, there could be multiple cross members dividing circular frame 18 into more section or, in lieu of cross members, a flat plate or surface could be formed inside the circular frame. However, the two cross members is the preferred embodiment in that they provide a suitable support surface yet allow for ventilation and drainage. Circular frame 18 also includes a series of evenly spaced, depending peripheral loops, 23 formed thereon for the frictional engagement of the basket wall loop hooks as will be explained in detail below. One preferred embodiment of the peripheral loop 23 is best seen in FIG. 6. As shown, loop 23 is formed as a loop in the wire which makes up circular frame 18. Each loop 23 hangs below the plane of circular frame 18. It will be appreciated, however, that circular frame 18 could be formed without peripheral loops 18 formed therein and separate loops 23 could be formed and appropriately attached to the circular frame by welding or the like. Peripheral loops 23 formed from circular frame 18 or added to the circular frame as separate elements are contemplated by the scope of the invention.

Basket 10 also includes a side or basket wall 14, as best seen in FIGS. 1–4. Basket wall 14 is comprised of a plurality of intertwined loops indicated generally by number 24. The basket illustrated by the drawings shows nine intertwined loops 24. Of course, a lesser or greater number of loops 24 can be used depending upon the size of the loops and the desired size of the basket. Any desired number of loops 24 employed in any given embodiment is contemplated by the scope of the instant invention. The intertwined relationship of the loops 24 is best illustrated in FIG. 5.

Figure 5:
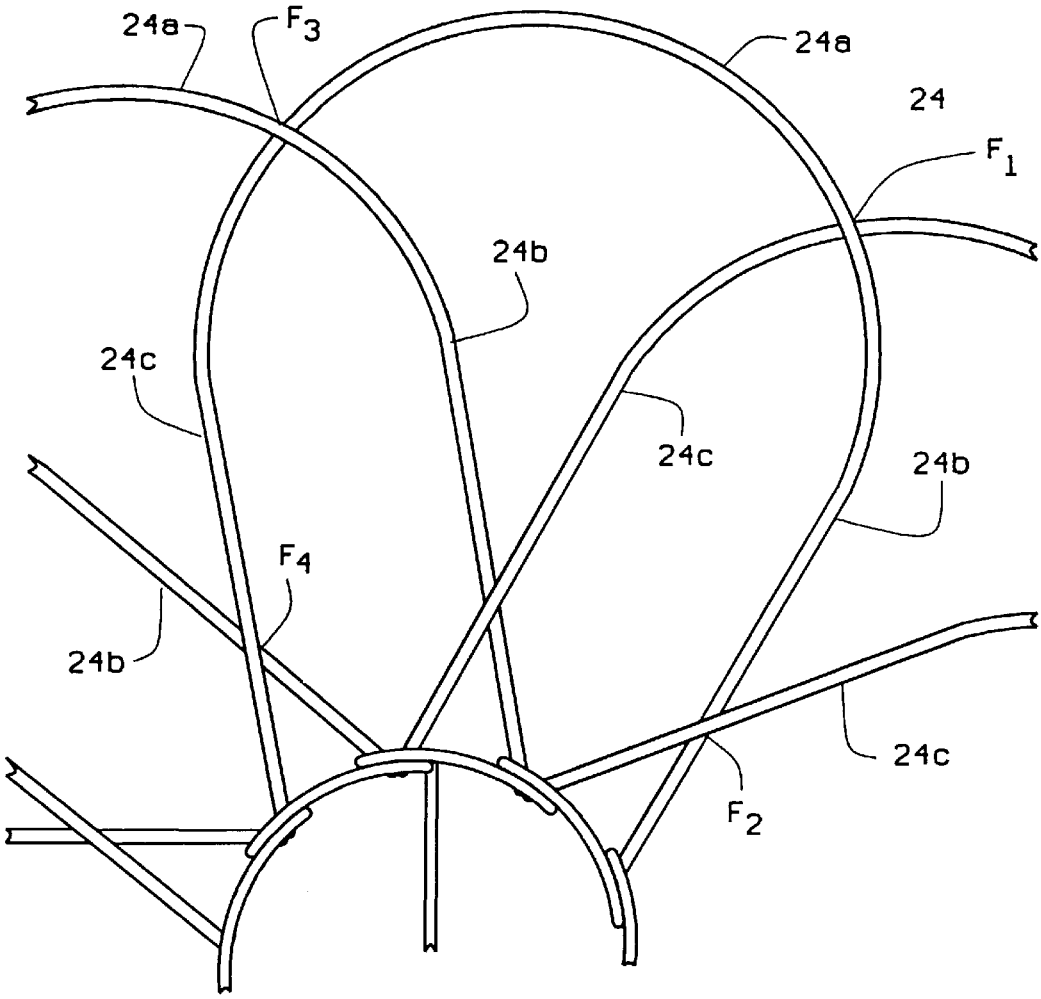
FIG. 5 is an enlarged section of a loop section of the basket wall illustrating the intertwined frictional arrangement of the wall loops.

As shown in FIG. 5, each loop 24 has a substantially U-shaped configuration comprised of a middle arc 24*a* and two leg sections 24*b* and 24*c*. As seen in FIG. 6, and as will be described in greater detail below, each leg section 24*b*, 24*c* terminates in a hook 26*a* and 26*b* respectively. The hooks 26*a* and 26*b* are designed to engage the peripheral loop 23 of circular frame 18 in a frictionally engaged hinged relationship, as will be described in greater detail below. It will be appreciated that hoops 24 are constructed from a resilient wire or other resilient material so that when loop 24 is formed it exerts an outward or biasing force as at arrows B1 and B1 of FIG. 6. Further, the resiliency of hoops 24 will allow them to increase in width or decrease in width, as needed, as the configuration of basket wall 14 is changed, as will be described below.

Returning to the description of the basket wall loops 24, FIG. 5 illustrates the intertwined relationship of the respective leg sections of adjacent loops 24 which contribute to the novel utility of basket 10. As can be seen, a leg section 24*c* of on loop is intertwined with a leg section 24*b* of an adjacent loop , creating a point of frictional engagement. For example, as shown at point F1, a leg 24*b* is on top of a leg 24*c* while at point F2, the leg 24*b* is under a leg 24*c*. Moreover, at point F3 a leg 24*c* is under a leg 24*b* while at point F4 the leg 24*c* is on top of a leg 24*b*. Thus, each loop 24 has at least four points of frictional engagement with adjacent loops 24 around the entire expanse of the basket. Because of the resiliency of the hoops, as described above, the intertwined legs are in a sliding arrangement whereby the relative width of the loops can be changed and the relative location of the frictional engagements F1–F4 will change along the lengths of the leg. It will be appreciated that the biasing forces B1 and B2 exerted by loop 24 also increases the frictional force at the respective points of frictional engagement F1–F4.

As best seen in FIG. 6, the respective hooks 26*a* and 26*b* each engage a peripheral loop 23 in a snug friction engagement. However, it will be appreciated that the hooks 26*a* and 26*b* can pivot or move about the loop so that the basket wall 14 can be moved relative to the base section 12 in any desired angular relationship, from the upright wall shown in FIG. 4 to a relatively flat configuration, as shown in FIG. 2.

Further, it will be appreciated that the novel combination of the plurality of frictional engagements F1–F4, the biasing forces B1 and B2 and the frictionally engaged hooks 26*a* and 26*b* allows for basket 10 to be arranged in any one of a number of desired configurations and for those configurations to be maintained. For example, basket 10 can be configured with basket wall 14 spread to increase internal volume 16 so as to accommodate larger contents, such as the potted plant P shown phantom in FIG. 3. Moreover, the wall 14 can be configured in more of an upright arrangement, decreasing the internal volume 16. Of course, the basket wall 14 can be maintained in any desired configuration and maintained in the desired configuration by the novel frictional engagement features.

It will be appreciated from the foregoing description that various changes and modifications may be made in the frictionally engaged adjustable basket without departing from the scope of the appended claims. Therefore, the foregoing description and accompanying drawings should be viewed as illustrative only and should not be construed in a limiting sense.

I claim:

1. A frictionally engaged adjustable basket comprising:

a base section;

a basket wall section hingedly and frictional connected to said base section, said basket wall section comprised of a plurality of resilient loops, each one of said loops being in an intertwined and frictionally engaged relationship with adjacent loops whereby said basket wall can be configured in a predetermined relationship to said base section and be maintained in said predetermined relationship.

2. The frictionally engaged adjustable basket of claim 1 wherein said base section farther comprises a plurality of evenly spaced peripheral loops, each said loop disposed to engage one of said plurality of basket wall section resilient loops in a frictionally biased arrangement.

3. The frictionally engaged adjustable basket of claim 2 wherein each said basket wall section resilient loops further comprises a pair of hooks for engaging one of said evenly spaced peripheral loops on said base section.

4. The frictionally engaged adjustable basket of claim 1 wherein each of said plurality of basket wall section resilient loops is constructed from a resilient metal wire.

5. The frictionally engaged adjustable basket of claim 4 wherein each of said plurality of basket wall section resilient loops constructed from a resilient metal wire is covered with a non-metal material.

6. The frictionally engaged adjustable basket of claim 5 wherein the non-metal material is plastic.

7. A frictionally engaged adjustable basket comprising:

a base section, said base section comprising a circular frame and at least one support member, said circular frame having a plurality of hook engagement loops thereon;

a basket wall section hingedly and frictional connected to said base section, said basket wall section comprised of a plurality of resilient loops, each one of said loops being in an intertwined and frictionally engaged relationship with adjacent loops, each said loop also comprising a first leg and a second leg, each said leg having a hook means formed thereon for engaging said hook engagement loops in a frictionally biased, hinged relationship whereby the angle between the basket wall can be adjusted and maintained.

* * * * *